US005755423A

United States Patent [19]

Michela

[11] Patent Number: 5,755,423

[45] Date of Patent: May 26, 1998

[54] FOLDING PORTABLE SUPPORT STAND

[76] Inventor: Joseph W. Michela, 1109 Harvard Rd., Waldorf, Md. 20602

[21] Appl. No.: 792,373

[22] Filed: Feb. 3, 1997

[51] Int. Cl.[6] ..... A47B 97/00

[52] U.S. Cl. ..... 248/459; 248/174; 248/460; 248/464

[58] Field of Search ..... 248/459, 460, 248/464, 174

[56] References Cited

U.S. PATENT DOCUMENTS

| | | | |
|---|---|---|---|
| 2,165,255 | 7/1939 | Hamilton | 248/459 |
| 2,375,190 | 5/1945 | Botts | 281/33 |
| 2,587,316 | 2/1952 | Henry | 248/35 |
| 2,640,294 | 6/1953 | Walzak | 45/121 |
| 2,726,835 | 12/1955 | Hummel | 248/459 |
| 2,844,347 | 7/1958 | Henry | 248/198 |
| 3,410,516 | 11/1968 | Criswell | 248/459 |
| 4,274,616 | 6/1981 | Radtke | 248/459 |
| 4,318,527 | 3/1982 | Smith | 248/459 |
| 4,607,817 | 8/1986 | Aquino | 248/459 |
| 4,610,416 | 9/1986 | Choi | 248/459 |
| 4,722,504 | 2/1988 | Degenholtz | 248/460 |
| 5,080,316 | 1/1992 | MacEwan | 248/459 |

FOREIGN PATENT DOCUMENTS

| | | | |
|---|---|---|---|
| 0442255 | 2/1936 | United Kingdom | 248/460 |

*Primary Examiner*—Victor N. Sakran

*Attorney, Agent, or Firm*—Roberts & Brownell, LLC

[57] ABSTRACT

A folding portable support stand suitable for a document or book. In the open configuration, the support stand is comprised of hinged triangular panels forming a tetrahedral stand assembly which support a pair of open covers forming an inclined angle with a horizontal surface such as a table. A prismatic ledge assembly is provided along the lower edge to retain the supported object on the covers and provide stiffness to the support stand in the open configuration. In the closed configuration, the support stand forms a flat rectangular shape with the covers on the outside surface and all other elements of the support stand folded within the covers. The support stand can be manufactured from a single sheet of material, and there are provisions for printed material on the surfaces of the support stand. Preferably, the support stand is manufactured of cardboard or paperboard, but alternatives include metal, plastic, and vinyl.

18 Claims, 2 Drawing Sheets

FIG. 3
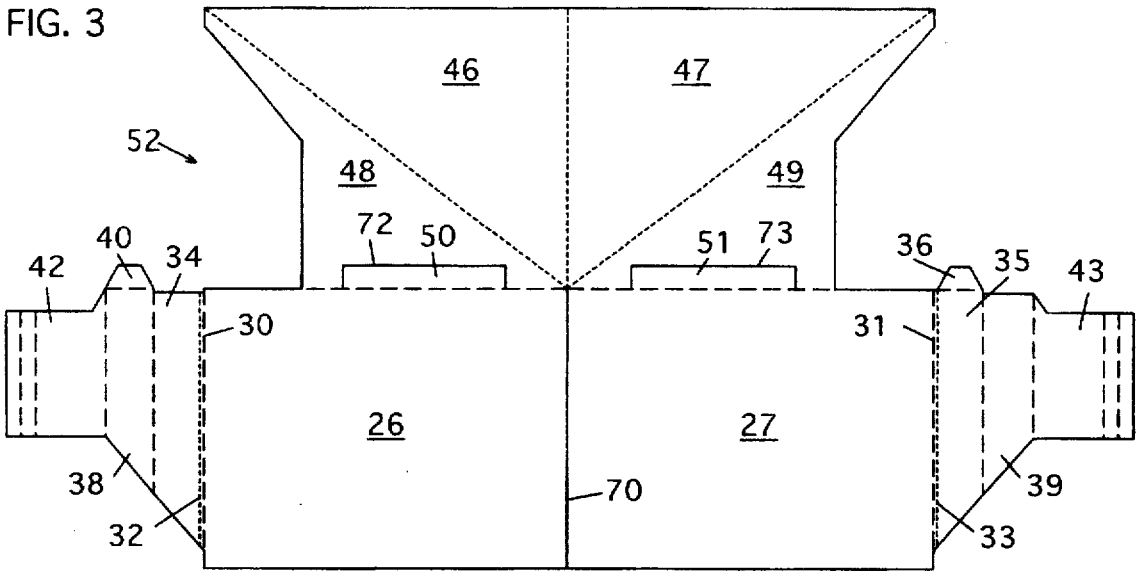
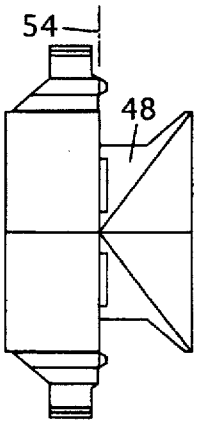
FIG. 4
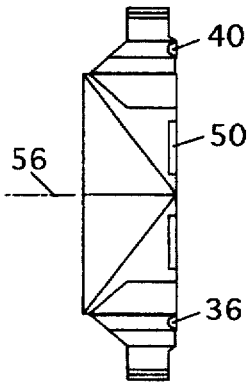
FIG. 5
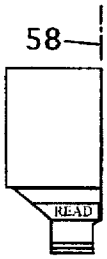
FIG. 6
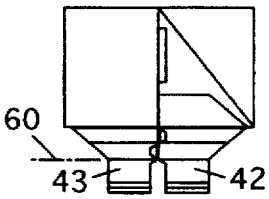
FIG. 7
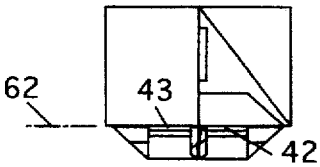
FIG. 8
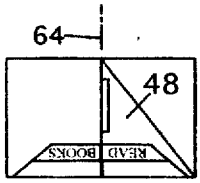
FIG. 9
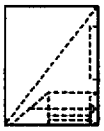
FIG. 10

FOLDING PORTABLE SUPPORT STAND

BACKGROUND OF THE INVENTION

1. Field of the Invention

This invention relates generally to a support device such as an easel or holder for documents, copy, sheet music, books, or other articles and more specifically to a freestanding collapsible version made of thin, stiff planar material, which is stored in a flat configuration. When unfolded, the device assumes a support shape through the use of various materials and the interaction of their shapes, folds and hinges.

2. Description of Related or Prior Art

There are a number of patents which disclose devices that support a document or book at an inclined angle above a horizontal surface. Some of those devices are manufactured from shaped metal rods or wire and are designed to fold or hinge into a flat shape and unfold or unhinge into a support shape. Other devices are manufactured from wood, plastic or fiber board and fold or hinge into a flat shape and unfold or unhinge into a support shape. Some of the relevant prior patents are described below.

U.S. Pat. No. 2,375,190 issued to H. P. Botts is drawn to a book mounting. This invention uses part of the cover to form a support stand. The support elements occur in the use of triangular members which provide the support of the book. This invention does not disclose an intrinsic latching capability to maintain the support shape and does not disclose a technique to maintain the support shape if the book is moved laterally. The invention does not require that it be formed as part of the book cover, however it is optimized for that purpose.

U.S. Pat. No. 2,587,316 issued to G. C. Henry is drawn to an article support through various arrangements of folded and joined panels. This invention uses two support panels. As disclosed, it is intended to be used either as an attachment to a book or as a separate item. However, when used as a separate item, this invention does not disclose an integral support at the lower edge to prevent a book from sliding off the invention. In addition, this invention does not disclose a regularly shaped structure. The '316 invention of Henry, as illustrated, consists of multiple individual panels with interconnecting hinges, and an efficient manufacturing method using a single sheet of material is not disclosed.

U.S. Pat. No. 2,640,294 issued to Walzak is drawn to a collapsible music stand or lectern. The invention comprises a stiffening member, such as wood, and is of a large size not suited for carrying in the smaller confines of a briefcase of knapsack. While the support member is folded inward when not in use, the folded shape is only partially regular having a separate member exposed which corresponds to the surface on which the music is placed.

U.S. Pat. No. 2,844,347 issued to G. C. Henry is drawn to a portable lectern comprising a number of hinged and foldable panels which forms a support shape. This invention principally comprises two main panels and has a support lip to retain and hold an object like a book from sliding off the support. This invention achieves and maintains its support shape through use of various elastic members. As with other prior art, the '347 invention does not disclose a regular shape when collapsed.

U.S. Pat. No. 4,318,527 issued to Smith is drawn to collapsible support structures. This invention provides for a support structure that is formed from essentially planar hinged panels. It forms a collapsible planar structure in the stowed position. It contains a lip to support a book with an arrangement to prevent or reduce the chance that a book or heavy object will slide off the invention. This invention uses a soft strip to restrain a book. In addition, as with other prior art, the '527 invention does not disclose a regular shape when collapsed.

U.S. Pat. No. 4,610,416 issued to Choi is drawn to a book holder. This invention is collapsible and separate from the supported book. This invention also provides a lip to keep an object like a book from sliding off the support. This invention discloses tabs inserted into slots, to maintain the support shape.

None of the above patents or existing technology addresses the need for a folding portable support stand suitable for holding a document or book that—performs the support function when detached or separated from the supported article; has an inherently stable shape; assumes a rectangular shape that is flat or planar when stored; retains a supported article on the structure through the shape of the device rather than through high friction devices or retention devices; does not require elastic elements or tabs to retain the shape of the device or the supported article; is inexpensive to manufacture and easy to use; and can be constructed of a variety of stiff planar materials such as but not limited to paperboard, vinyl/cardboard members, plastic and/or aluminum.

SUMMARY AND OBJECTS OF THE INVENTION

The present invention resolves the deficiencies of the prior art through a unique combination of materials, shapes, folds, and hinges on the device, without the need for elastic elements or tabs that must be inserted into slots of other members to maintain the support shape of the device.

As a result, the present invention provides a folding portable support stand suitable for reliably holding documents, copy, sheet music, books or other articles at a convenient angle for viewing, on top of a flat horizontal surface, such as a table. Further, the present invention is inexpensive to manufacture and easy to use. It can be made from paperboard and manufactured in a unitary "blank," or made from other materials such as vinyl, plastic, and metal with elements in the same general size and shape giving rise to the folding geometry described in detail herein. It further provide a means to advertise names or products on the flat surfaces (referred to as "covers" in this specification) of the invention since the folding geometry of the invention allows the covers to be folded away from each other (as opposed to being folded toward each other) thereby making the covers continually visible even in the fully folded position.

It is therefore an object of the present invention to provide a device that achieves a stable and rigid support shape through a combination of materials, shapes, folds and hinges on the device.

It is a further object of the present invention to provide a device that is inherently strong and stable when open.

It is a further object of the present invention to provide a device that does not require elastic elements or tabs to to be inserted into slots in order to retain the shape of the device or the position of the supported article.

It is a further object of the present invention to provide a device that is inexpensive to manufacture and easy to use.

It is a further object of the present invention to provide a device that is capable of easily being manufactured from a single sheet of material using automated processes or using a variety of materials in a variety of configurations.

It is a further object of the present invention to provide a device that is easily adapted to carry printed instructions, information and material, such as advertising.

It is a further object of the present invention to provide a device that is thin, lightweight and ideally shaped when collapsed for storage in brief cases, back packs, boxes, or shelves.

It is a further object of the present invention to provide a device that can be quickly and silently set up and taken down, even by a child, much like opening and closing a book.

These and other objects of the present invention will become obvious to those skilled in the art upon review of the following disclosure.

BRIEF DESCRIPTION OF THE DRAWINGS

FIG. 3: Illustrates the preferred embodiment of the present invention as a flat object or blank before the object or blank is formed into the final arrangement of the present invention.

FIG. 4: Illustrates a fold axis and glue area on the blank of the preferred embodiment of the present invention.

FIG. 5: Illustrates a fold axis and glue areas on the blank of the preferred embodiment of the present invention.

FIG. 6: Illustrates a fold axis on the blank of the preferred embodiment of the present invention.

FIG. 7: Illustrates a fold axis on the blank of the preferred embodiment of the present invention.

FIG. 8: Illustrates a fold axis and glue areas on the blank of the preferred embodiment of the present invention.

FIG. 9: Illustrates a fold axis and a glue area on the blank of the preferred embodiment of the present invention.

FIG. 10: Illustrates the preferred embodiment of the present invention in the stowed or closed position.

DETAILED DESCRIPTION OF THE PREFERRED EMBODIMENT

Figure 1:
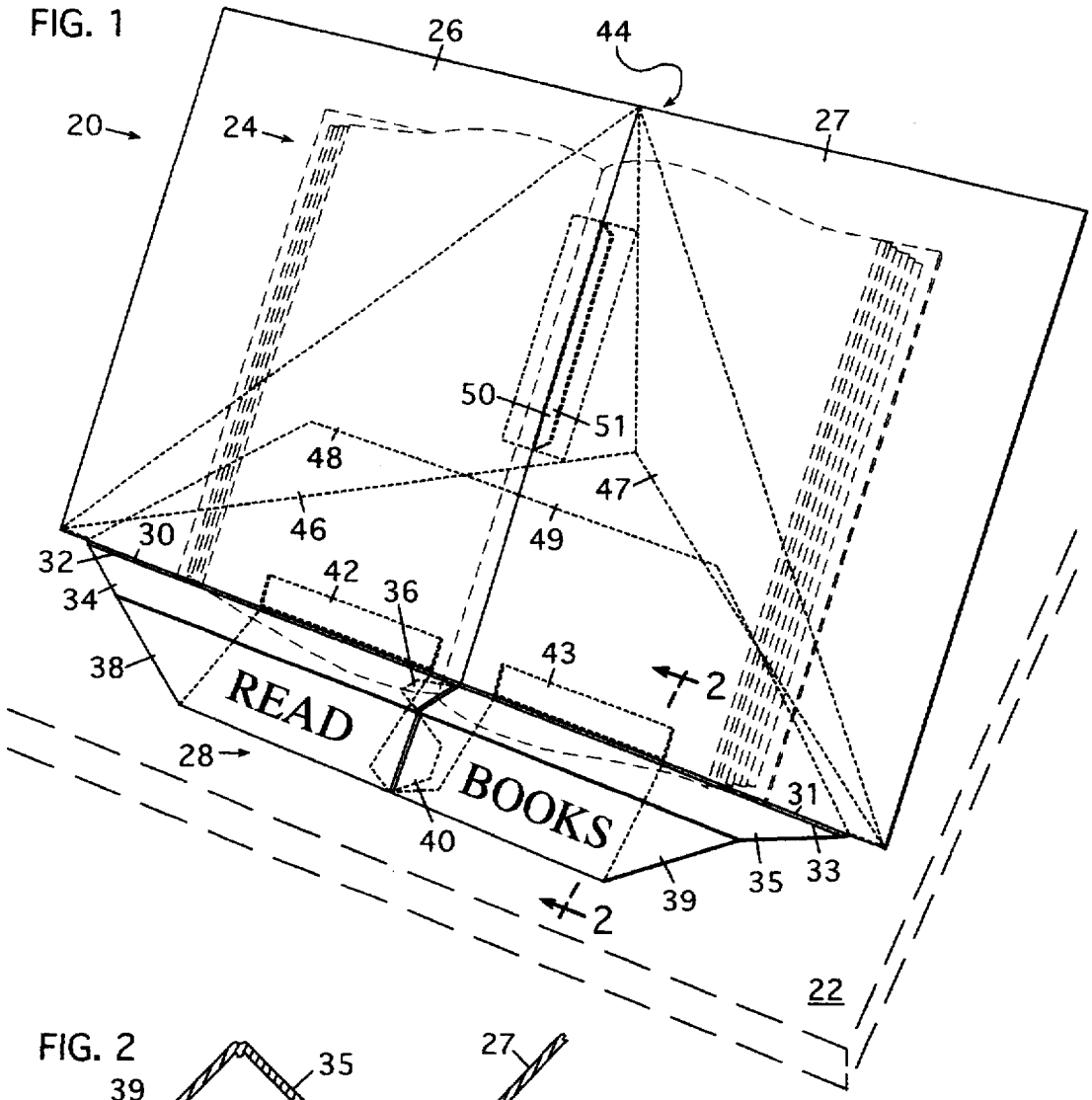
FIG. 1: Illustrates the preferred embodiment of the present invention in the deployed or open position supporting a document or book.

Referring to FIG. 1, the preferred embodiment of the present invention 20 is shown in the open or deployed position. In this position, the present invention is shown to be a support stand capable of supporting a document, copy, sheet music, book, or other article. Two covers, left 26 and right 27, are in a planar arrangement and the covers form a flat inclined surface against which the supported article 24 rests (Note: for purposes of illustration only a book is shown). FIG. 1 also shows two supports 46 and 47 which form the primary support for the device and achieve a support shape. The two halves of a ledge 34 and 35 are also shown in the position which allows them to retain the supported document, copy, music, book, or other article on the covers against the force of gravity. The present invention can be constructed of paperboard, vinyl/cardboard members, rigid plastic, aluminum or other materials having the properties of light weight, rigidity/stiffness, easy folding or the capacity of being easily connected via hinges of various types. It will be appreciated by those skilled in the art that "piano" type hinges of varying sizes and materials can be used instead of the hinges described herein to achieve the folding geometry of the present invention without departing from the spirit of the invention as disclosed. For example a thin vinyl strip is a sufficient hinge material when the present invention is made of cardboard reinforced vinyl members. When more rigid plastic is used, a hinge may be integrally molded into the panels to be attached to one another. When the invention is made from aluminum. Piano type (or other type) hinges may be integrally formed, or attached with rivets or other bonding means to create the folding members as described.

Figure 2:
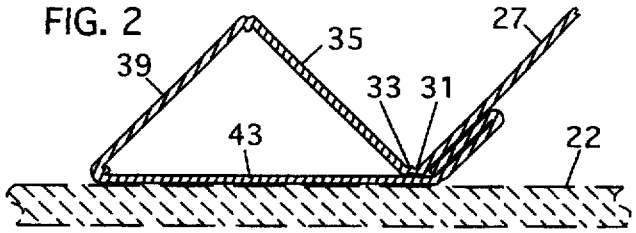
FIG. 2: Illustrates the prismatic ledge assembly of the preferred embodiment of the present invention in the deployed or open position.

Referring to FIG. 2, a sectional view of the preferred embodiment of the present invention is shown in the deployed or open position. In this view, the ledge 35 can be seen to form an arrangement that will retain the document, copy, music, or book at an elevated angle above the table 22. FIG. 2 also shows the interrelationship of the cover 27, ledge 35, brace 39 and restraint 43. In this arrangement, the ledges will retain the document, copy, sheet music, book, or other article at an elevated angle without sliding off the covers.

Referring again to FIG. 1, the present invention rests atop a flat horizontal surface 22, such as a table. The open book is inclined backward against a pair of rectangular covers 26 and 27. The book is supported at the bottom by a prismatic ledge assembly 28, containing a pair of backward hinges 30 and 31, a pair of forward hinges 32 and 33, a pair of ledges 34 and 35, a ledge tab 36, a pair of braces 38 and 39, a brace tab 40, and a pair of restraints 42 and 43. The ledges are attached to the covers by hinges 30, 31, 32 and 33, and to each other by the ledge tab 36. The ledge tab is hinged to the right ledge and glued to the lower surface of the left ledge. The ledges are held substantially at a right angle to the covers by the braces. The braces are hinged to the ledges and are attached to each other by the brace tab 40. The brace tab is hinged to the left brace and glued to the lower face of the right brace. The ledges and braces are prohibited from sliding flat onto the table, when subjected to the weight of a book, by the restraints. One end of each restraint is hinged to the corresponding brace. The other end of each restraint is glued flat to the back side of the corresponding cover.

Referring again to FIG. 2, the cooperation of cover 27, hinge 31, hinge 33, ledge 35, brace 39, and restraint 43 to create the prismatic ledge assembly on surface 22 is more clearly shown in cross section. The triangular cross section makes the ledge assembly inherently strong and rigid when it rests on the flat horizontal surface.

Referring again to FIG. 1, the ledge tab 36 and brace tab 40, connect the left and right ledge assembly halves into a single, continuous, inflexible unit, like a rod, or bar. This bar both supports the book and maintains the covers rigidly coplanar.

Referring again to FIG. 1, the covers are sustained from behind by a tetrahedral stand assembly 44, comprising a pair of supports 46 and 47, a pair of connectors 48 and 49, and a connector hinge comprising two members 50 and 51. The supports 46 and 47 are hinged to each other and to the connectors 48 and 49. The connectors are also glued to the back faces of the covers. The connector hinge comprising the two members 50 and 51, which are glued together, attaches the two connectors to each other.

PREFERRED METHOD OF ASSEMBLY

Referring to FIG. 3, a paperboard blank 52 viewed from the back of the present invention is illustrated. In this initial form, the present invention is a flat blank, with selected cuts and scoring, from which the stand is assembled. If desired, printing can be applied to either, or both sides before assembly. Solid lines in the figure indicate cuts, as illustrated at 70, 72 and 73. Short dashed lines in the illustration indicate fold lines wherein the members on either side of the line are folded down (away) from the viewer. Longer dashed lines indicate fold lines wherein the members on either side of the fold line are folded up (toward) the viewer.

Referring to FIG. 4, in the first assembly step, glue is applied to the exposed back side of connector 48, then the object is folded around axis 54. On completion of this step, the object appears as illustrated in FIG. 5.

Referring now to FIG. 5, in the next assembly step, glue is applied to the newly exposed front sides of connector hinge half 50, ledge tab 36, and brace tab 40, then the object is folded around axis 56. On completion of this step, the object appears as illustrated in FIG. 6.

Referring now to FIG. 6, the next assembly step is to partially open the present invention by rotating around axis 58. The three hinges, newly created by the previous assembly step, form the axis of rotation. On completion of this step, the object appears as illustrated in FIG. 7.

Referring now to FIG. 7, in the next assembly step, the restraints 42 and 43 are folded upward, without glueing, around axis 60. On completion of this step, the object appears as illustrated in FIG. 8.

Referring now to FIG. 8, in the next assembly step, glue is applied to the newly exposed front faces of the ledges 42 and 43, but only in the area between the unattached end of each restraint and the hinge line nearest to the unattached end of each restraint. Then everything below axis 62 is folded upward. On completion of this step, the object appears as illustrated in FIG. 9.

Referring now to FIG. 9, in the next assembly step, glue is applied to the exposed back side of connector 48, and the object is folded around axis 64. On completion of this step, the object appears as illustrated in FIG. 10.

Referring now to FIG. 10, the completed assembly of the stand of the present invention is illustrated, with hidden elements revealed.

METHOD OF OPERATION

Following assembly of the present invention, as discussed above, one method for opening or deploying it from the stowed position, as illustrated in FIG. 10, to achieve the support shape, as illustrated in FIG. 1, includes the following steps. Beginning with the collapsed stand, shown in FIG. 10, the stand is opened by separating the covers 26 and 27 at the edges opposite the connector hinge, in the same manner as opening a book. The covers are opened until they both lay flat, face down on the table. This opening motion automatically erects the tetrahedral stand assembly 44, which then stands like a hollow pyramid with one face open above the table. The prismatic ledge assembly remains collapsed, flat against the back faces of the covers. When the covers become flat and face down on the table, all left elements in the prismatic ledge assembly become lined up with their right counterparts. Among them, hinges 30 and 31 become co-linear and can therefore act as a single hinge. The entire ledge assembly is then swung up and away from the covers around hinges 30 and 31 until ledges 34 and 35 have pivoted through about 180 degrees and lie face down on the table, like the covers. As soon as the ledges start to swing, the covers become locked into coplanar alignment. At the same time, the restraints begin to restrict the motion of the braces. While the braces can lie coplanar with the ledges in the collapsed position, they can not remain coplanar when the assembly swings out. This is because the restraints are effectively tethered to the covers at a point significantly distant from hinges 30 and 31, as illustrated in FIG. 2. The stand is next picked up off the table, preferably by the hollow pyramid, and turned right side up, and the prismatic ledge assembly is swung approximately 90 degrees around hinge 32 and 33 to its final position. When the stand is set down on the table, it is in the open position and ready for use, as illustrated in FIG. 1.

To return the stand from the opened or deployed position, as illustrated in FIG. 1 to the collapsed configuration, as illustrated in FIG. 10, the stand is lifted from the table. The ledge assembly can then be swung back to the flat position against the back face of the covers. When the ledge assembly makes contact with the back faces of the covers, the covers are no longer locked open and can be collapsed, in the same manner that a book is closed.

Through the unique method of assembly and operation, the folding portable support stand of the present invention resolves deficiencies of the prior art. In particular, the irregular outlines and discontinuous faces of prior art stands, wherein the covers fold forward, have been eliminated by folding the covers of the present invention in the opposite direction. This provides a smooth, flat surface and, preferably, a rectangular outline when collapsed. Further, use of an inherently stable tetrahedral stand in the present invention, locked in open position by the ledge assembly provides significant stability and sturdiness. The prismatic ledge assembly further provides rigidity, and collapsibility in addition to holding the supported object from sliding off the open covers. The prismatic ledge is strong when open, flat when collapsed, and easily opened or collapsed. The present invention is capable of economical production or manufacture from a single flat blank by automatic assembly machinery. Finally, all elements of the present invention are durable without rubbing against each other, like tabs in slots.

ALTERNATIVES TO THE PREFERRED EMBODIMENT

Without limiting various alternatives to the preferred embodiment of the present invention, the following examples serve to illustrate the range of broad possible changes to materials, elements, assembly and structure that are possible while satisfying the objects of the present invention.

The preferred embodiment is made of paperboard. But the basic elements of simply shaped panels, like triangles and rectangles, or substantial approximations thereof, connected by hinges, can be produced using any other material or combination of materials which can be shaped into panels and hinged together, even if they are much thicker than paperboard. Such materials include cardboard, sheet plastic, stiffened cloth, vinyl covered binder board, hardback book binding materials, sheet aluminum, molded plastic, leather, or carbon fiber epoxy composites. Hinges could be made of such materials as cloth, paper, plastic tape, vinyl, plastic, or metal.

The blank in FIG. 3 illustrated one arrangement of the elements on the blank, though others are possible. For example, the blank shown creates the hinge between supports with a score line and creates the hinge between connectors with hinge halves 50 and 51. The elements could be arranged so the connectors are side by side and hinged by a score line and the supports are given hinge halves by which they will be attached to each other. Other variations may be more or less suitable to the manufacturing process available and the desired end product.

Additional features can be incorporated into the blank as alternatives. For example, it is possible to create a pair of buttresses which give greater rigidity to the upper outer corners of the covers, and extend from the cover-to-cover joint inside the tetrahedron toward the outer corners of the covers, which automatically erect themselves when the covers are opened and fold flat when the covers are closed, as the tetrahedron does, and which can be formed from existing, material in the blank. Such an option would allow use of thinner material.

Another possible alternative is a set of struts which partially close the open face of the tetrahedron, are attached to the long sides of the supports and to each other, which self-erect and collapse with the covers, and which give greater rigidity and strength to the supports. This option also might allow thinner paperboard to be used.

Another alternative, which requires additional material, allows the blank to be printed on one side only, yet, when the stand is assembled, all visible surface of the stand are printed.

The angle between the table surface and the open reclining covers is determined by the ratio of length to width of the rectangle formed by the collapsed stand. As the rectangle approaches a square, the ratio approaches 1:1, and the angle approaches ninety degrees. As the ratio approaches 1:0, the angle of inclination approaches zero degrees. One typical page size produces a ratio of 8.5:11 which yields a serviceable angle of inclination. Other ratios may be equally suitable for various purposes.

The stand is operationally sensitive to the angle between the covers and ledges in the open position. If that angle is less than ninety degrees, the pages become hard to turn because they catch on the ledge. An angle just slightly greater than ninety degrees eliminates this problem. This angle is determined by the cooperation of all members of the ledge assembly, as can be clearly seen in FIG. 2. Thus, the widths of the ledges and braces and the length of the restraints must all be determined interactively. The embodiment illustrated here gives the ledge and brace equal width and the restraint length is calculated to yield a ninety degree angle between them. Other ratios and angles may be equally suitable.

The closely spaced backward and forward hinges 30, 31, 32, and 33 are intended to allow the ledge assembly to swing approximately 270 degrees without unduly stressing the paperboard. Hinges 30 and 31 are scored from opposite faces of the blank than hinges 32 and 33 so they swing in opposite directions. The backward hinges 30 and 31 allow the assembly to swing 180 degrees, from a position flat against the backside of the covers to a position coplanar with the covers, without damaging the hinge. The cooperating forward hinges 32 and 33 allows at least an additional 90 degrees of swing without damage. If the same effect can be achieved by careful selection of materials and a single hinge, the second score can be eliminated.

The effective operation of the restraints is very sensitive to the overall length of the restraint and the width of the area where it is glued to the back side of the covers. In the collapsed position, the restraint should preferably lie flat between the cover and the coplanar ledge and brace. Thus, the restraint should preferably be no longer than the combined widths of the ledge and brace. In the open position, the part of the restraint that is not glued to the covers must be of the appropriate length to yield the desired cover-to-ledge angle. Thus, the position of the hinge line closest to the end of the restraint must be such as to yield the necessary effective length of the free restraint.

The ledge and brace are tapered at their outer edges, but need not be so. The ledge assembly must be able to swing past the supports, during opening or collapsing movements. Any size or shape of ledge assembly which gives that clearance is viable. Cutting away sections of the supports to give needed clearance greatly reduces the rigidity of the open stand, and is not recommended, when using paperboard. Stiffer materials can overcome the issue.

The connectors are essentially shaped like right triangles with a quadrilateral cut out of the lower side to accommodate the collapsed ledge assembly. The purpose of this cutout is to eliminate two unnecessary layers of thickness in the collapsed stand. The cutout can be eliminated, but as the thickness of the sheet material is increased the cutout becomes increasingly appropriate. If the cutouts are eliminated, the prismatic ledge assembly can just as easily be attached to the connector as to the covers. If the ledge assembly is attached to the connectors, the covers can be done away with completely, leaving only the tetrahedral stand and the prismatic ledge assembly. Such an arrangement can be made and operated essentially the same way as the preferred embodiment, but presents a remarkably different appearance without the covers.

The ledges do not extend all the way to the outer corners of the covers in the preferred embodiment. This allows a "leg" of the connectors to extend beside the cutout where glue can be applied to stabilize the hinge between the connector and the support. However, if extra thickness is not a concern, the ledge can be extended all the way to the outer corners of the covers.

As illustrated in FIG. 1, the abutting edges of the covers and connectors in the open stand are not connected to each other except through the hinge created when tabs 50 and 51 are glued together, which hinge does not run the full length of the connector-to-connector joint. This arrangement allows the covers to spread apart, when collapsed, to accommodate the thickness of the doubled over ledge assembly. As the thickness of the panel material is increased, it becomes increasingly critical that the rotation axes of the following three hinges remain substantially collinear with each other in the collapsed position: connector hinge 50 and 51, the hinge on ledge tab 36 and the hinge on brace tab 40. Failure to preserve this collinearity will cause destructive stress when the stand is opened or collapsed.

The preferred embodiment produces a rectangular shape when collapsed. Other outlines are feasible, either by cutting of comers or edges, or by changing the angles involved.

What is claimed is:

1. A folding portable support stand suitable for holding a document, copy, sheet music, book, or other article at an elevated angle above a horizontal surface comprising:

(a) a pair of covers, each having a front and back surface, a lower edge and a vertical edge;

(b) a tetrahedral stand assembly having a pair of connectors which are fixedly attached to the back surface of the covers;

(c) a document support means which is hingedly attached to the lower edge of the covers, and wherein the folding portable support stand further comprises:

(d) an open configuration whereby the tetrahedral stand assembly and covers form an elevated planar surface, and the document supporting means retains the document, copy, sheet music, book, or other article on the covers in the open configuration; and (e) a closed configuration in which the front surfaces of the covers are visible on the outside and whereby the tetrahedral stand assembly, and document supporting means fold flat within the covers and remain assembled ready for use.

2. The folding portable support stand of claim 1 wherein the tetrahedral stand assembly further comprises:

(a) a pair of connectors which are fixedly attached to the back surfaces of the covers; and (b) a pair of supports with a first and second edge, which are hingedly attached to each other along the first edge and hingedly attached to the connectors along the second edge.

3. The tetrahedral stand assembly of claim 2 wherein the means for hingedly attaching the supports to each other, and hingedly attaching the supports to the connectors further comprise scored tabs, which tabs are fixedly attached to the opposite mating surface.

4. The tetrahedral stand assembly of claim 2 wherein the means for hingedly attaching the triangular supports to each other, and hingedly attaching the triangular supports to the connectors further comprise cloth, paper, plastic tape, vinyl, plastic, metal hinges.

5. The folding portable support stand of claim 2 wherein the means for hingedly attaching is tape taken from the group consisting of cloth, paper, plastic tape, vinyl, and plastic tape.

6. The folding portable support stand of claim 2 wherein the means for hingedly attaching is tabs which tabs are fixedly attached to the opposite mating surface.

7. The folding portable support stand of claim 1 wherein the document supporting means is a prismatic ledge assembly which further comprises:

(a) a pair of ledges with a first, second and third edge, which are hingedly attached to each other along the first edge and which are hingedly attached to one item taken from the group consisting of covers and tetrahedral stand;

(b) a pair of braces with a first, second and third edge which are hingedly attached to each other along the first edge and which are hingedly attached along their second edge to the second edge of the ledges; and (c) a pair of restraints with a first and second edge which are hingedly attached along their first edge to the third edge of the braces and which pair of restraints are hingedly attached along their second edge to one item taken from the group consisting of connectors and covers.

8. The prismatic ledge assembly of claim 3 wherein the means for hingedly attaching the ledges to each other, hingedly attaching the braces to each other, and hingedly attaching the ledges, braces and restraints to each other and the tetrahedral stand assembly further comprise scored tabs, which are integral pieces of the ledges, braces, restraints and tetrahedral stand assembly, and which tabs are fixedly attached to the opposite mating surface.

9. The prismatic ledge assembly of claim 3 wherein the means for hingedly attaching the ledges to each other, hingedly attaching the braces to each other, and hingedly attaching the ledges, braces and restraints to each other and the tetrahedral stand assembly further comprise cloth, paper, plastic tape, vinyl, plastic, metal hinges.

10. The folding portable support stand of claim 3 wherein the means for hingedly attaching is tape taken from the group consisting of cloth, paper, plastic tape, vinyl, and plastic tape.

11. The folding portable support stand of claim 3 wherein the means for hingedly attaching comprise scored tabs which tabs are fixedly attached to the opposite mating surface.

12. The folding portable support stand of claim 1 wherein the covers, tetrahedral stand assembly, and prismatic ledge assembly are constructed of material from the group consisting of paperboard, cardboard, metal, sheet plastic, stiffened cloth, vinyl covered binder board, hardback book binding materials, molded plastic, leather, and carbon fiber epoxy composites.

13. The folding portable support stand of claim 1 wherein the means for hingedly attaching the connectors to each other, and the document support means to the covers further comprise scored tabs, which are integral pieces of the connectors, and document support means and which tabs are fixedly attached to the opposite mating surface.

14. The folding portable support stand of claim 1 wherein the means for hingedly attaching the connectors to each other, the document support means to the covers, and the document support means to the connectors are taken from the group consisting of cloth, paper, plastic tape, vinyl, plastic, metal hinges.

15. The folding portable support stand of claim 1 wherein the covers, tetrahedral stand assembly, and document support means further comprise a combination of individual elements such that all elements are arrayed on a single sheet of material in such a way as to provide for hinged connections between certain of the elements.

16. The folding portable support stand of claim 11 wherein the covers, tetrahedral stand assembly, and prismatic ledge assembly further comprise a combination of individual elements such that instructions, and other information can be applied to the individual elements on the single sheet through printing.

17. The folding portable support stand of claim 1 wherein the means for hingedly attaching is tape taken from the group consisting of cloth, paper, plastic tape, vinyl, and plastic tape.

18. The folding portable support stand of claim 1 wherein the means for hingedly attaching is tabs which tabs are fixedly attached to the opposite mating surface.

* * * * *